US011378324B2

(12) United States Patent
Coldre

(10) Patent No.: US 11,378,324 B2
(45) Date of Patent: Jul. 5, 2022

(54) MODULAR COLD BOXES FOR TRANSPORT REFRIGERATION UNIT

(71) Applicant: Carrier Corporation, Palm Beach Gardens, FL (US)

(72) Inventor: Laurent Coldre, La neuville sur essonne (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 95 days.

(21) Appl. No.: 15/769,147

(22) PCT Filed: Oct. 22, 2015

(86) PCT No.: PCT/IB2015/002118
§ 371 (c)(1),
(2) Date: Apr. 18, 2018

(87) PCT Pub. No.: WO2017/068384
PCT Pub. Date: Apr. 27, 2017

(65) Prior Publication Data

US 2018/0306480 A1 Oct. 25, 2018

(51) Int. Cl.
*F25D 11/00* (2006.01)
*F25D 17/06* (2006.01)
(Continued)

(52) U.S. Cl.
CPC ..... *F25D 11/003* (2013.01); *F25D 15/00* (2013.01); *F25D 17/045* (2013.01); *F25D 17/06* (2013.01); *F25D 2700/12* (2013.01)

(58) Field of Classification Search
CPC ..... F25D 11/003; F25D 17/06; F25D 17/045; F25D 17/005; F25D 19/003; F25D 11/00;
(Continued)

(56) References Cited

U.S. PATENT DOCUMENTS 3,275,188 A * 9/1966 Wilson ..... B65D 21/068 206/505
3,477,243 A * 11/1969 Huck ..... B65D 88/745 62/298
(Continued)

FOREIGN PATENT DOCUMENTS

CN 101003323 A 7/2007
CN 101482354 A 7/2009
(Continued)

OTHER PUBLICATIONS

Written Opinion re Singapre Application No. 11201802903S dated Feb. 13, 2019; 5 pages.
(Continued)

*Primary Examiner* — Avinash A Savani
*Assistant Examiner* — Dana K Tighe
(74) *Attorney, Agent, or Firm* — Cantor Colburn LLP

(57) ABSTRACT

A transport containment assembly (26) includes a refrigeration unit (36) and a container (34). The container (34) houses a plurality of boxes (52) of the transport containment assembly (26) for storage of cargo. The plurality of boxes (52) are configured in series with one-another for the flow of cooling air from the refrigeration unit (36).

4 Claims, 4 Drawing Sheets

(51) Int. Cl.
*F25D 15/00* (2006.01)
*F25D 17/04* (2006.01)

(58) Field of Classification Search
CPC ..... F25D 11/006; F25D 17/04; F25D 17/042; F25D 17/047; F25D 17/08; B65D 88/745
USPC ..... 62/431; 454/90, 174, 259; 99/476
See application file for complete search history.

(56) References Cited

U.S. PATENT DOCUMENTS

| | | | | |
|---|---|---|---|---|
| 3,977,208 | A | 8/1976 | Heighton | |
| 4,003,728 | A * | 1/1977 | Rath | B60P 3/20 62/78 |
| 4,049,233 | A | 9/1977 | Brandin | |
| 4,779,524 | A * | 10/1988 | Wade | A23B 7/152 426/263 |
| 4,819,820 | A | 4/1989 | Weiner | |
| 5,297,616 | A | 3/1994 | Pralus | |
| 5,531,158 | A * | 7/1996 | Perryman, Jr. | A23B 7/148 99/467 |
| 5,649,432 | A | 7/1997 | Cavalea, III | |
| 6,443,309 | B1 * | 9/2002 | Becker | B65D 5/60 206/594 |
| 6,901,768 | B1 * | 6/2005 | Windecker | A23B 7/148 62/239 |
| 7,913,513 | B1 | 3/2011 | Bottom et al. | |
| 8,936,203 | B2 * | 1/2015 | Jackson | F24F 13/14 236/49.5 |
| 2004/0178161 | A1 | 9/2004 | Galustyan | |
| 2006/0113302 | A1 | 6/2006 | Mandava et al. | |
| 2009/0242579 | A1 | 10/2009 | Huang | |
| 2010/0224624 | A1 * | 9/2010 | Gonzalez | B65D 88/745 220/1.5 |
| 2013/0111726 | A1 | 5/2013 | Krieger | |
| 2015/0233648 | A1 | 8/2015 | Goseling | |
| 2015/0250225 | A1 * | 9/2015 | Hata | F25D 17/06 62/344 |
| 2015/0316311 | A1 * | 11/2015 | Kopecka | B60H 1/00014 62/95 |

FOREIGN PATENT DOCUMENTS

| | | | |
|---|---|---|---|
| CN | 202902730 | U | 4/2013 |
| CN | 104302992 | A | 1/2015 |
| CN | 104823008 | A | 8/2015 |
| DE | 3134987 | A1 | 3/1983 |
| EP | 0254947 | A2 | 2/1988 |
| FR | 2580061 | A1 | 10/1986 |
| GB | 1523994 | A | 9/1978 |
| JP | S6334472 | A | 2/1988 |
| JP | S63180061 | A | 7/1988 |
| WO | 2006100412 | A1 | 9/2006 |
| WO | 2014104985 | A1 | 7/2014 |

OTHER PUBLICATIONS

European Office Action for Application No. 15798187.9 dated Jun. 7, 2019; 34 pages.

International Search Report from the International Searching Authority for International Application No. PCT/IB2015/002118; Date of Completion: Jun. 28, 2016; dated Jul. 8, 2016; 7 Pages.

Written Opinion from the International Searching Authority for International Application No. PCT/IB2015/002118; International Filing Date: Oct. 22, 2015; dated Jul. 8, 2016; 6 Pages.

First Chinese Office Action to Chinese Application No. 201580084019.1; dated Nov. 28, 2019; 9 Pages.

Chinese Office Action for Chinese Application No. 201580084019.1; dated Jul. 10, 2020; 10 Pages.

Translation of Chinese Office Action for Chinese Application No. 201580084019.1; dated Jul. 10, 2020; 12 Pages.

Chinese Office Action for Chinese Application No. 201580084019.1; dated Jan. 4, 2021; 5 Pages.

Communication from the European Patent Office for European Application No. 15798187.9; dated Aug. 27, 2020; 8 Pages.

* cited by examiner

MODULAR COLD BOXES FOR TRANSPORT REFRIGERATION UNIT

CROSS REFERENCE TO RELATED APPLICATIONS

This application is a 371 of International Application No. PCT/IB2015/002118, filed Oct. 22, 2015, which is incorporated by reference in its entirety herein.

BACKGROUND

The present disclosure relates to transport refrigeration units and, more particularly, to modular cold boxes for the transport refrigeration unit.

Traditional refrigerated cargo trucks or refrigerated tractor trailers, such as those utilized to transport cargo via sea, rail, or road, is a truck, trailer or cargo container, generally defining a cargo compartment, and modified to include a refrigeration system located at one end of the truck, trailer, or cargo container. Refrigeration systems typically include a compressor, a condenser, an expansion valve, and an evaporator serially connected by refrigerant lines in a closed refrigerant circuit in accord with known refrigerant vapor compression cycles. A power unit, such as a combustion engine, drives the compressor of the refrigeration unit, and may be diesel powered, natural gas powered, or another type of engine. In many tractor trailer transport refrigeration systems, the compressor is driven by the engine shaft either through a belt drive or by a mechanical shaft-to-shaft link. In other systems, the engine drives a generator that generates electrical power, which in-turn drives the compressor.

The refrigeration units typically cool the entire compartment defined by the cargo container. Opening and closing of container doors may lead to cooling inefficiency and reduced temperature control. Manufacturers and operators of fleets of refrigerated trucks, trailers and/or cargo containers desire to maximize operational efficiency and control of the entire cooling process.

SUMMARY

A transport containment assembly according to one, non-limiting, embodiment of the present disclosure includes a refrigeration unit; a container; and a plurality of boxes for storage of cargo and configured in series with one-another for the flow of cooling air from the refrigeration unit.

Additionally to the foregoing embodiment, each one of the plurality of boxes are insulated.

In the alternative or additionally thereto, in the foregoing embodiment, adjacent boxes of the plurality of boxes are detachably engaged to one-another.

In the alternative or additionally thereto, in the foregoing embodiment, each one of the plurality of boxes define a cavity and each cavity of the adjacent boxes are in fluid communication with one-another.

In the alternative or additionally thereto, in the foregoing embodiment, the transport containment assembly includes a supply duct in fluid communication between the refrigeration unit and a leading box of the plurality of boxes.

In the alternative or additionally thereto, in the foregoing embodiment, the supply duct is detachably connected to the leading box.

In the alternative or additionally thereto, in the foregoing embodiment, the transport containment assembly includes a return duct in fluid communication between the refrigeration unit and a trailing box of the plurality of boxes.

In the alternative or additionally thereto, in the foregoing embodiment, the return duct is detachably connected to the trailing box.

In the alternative or additionally thereto, in the foregoing embodiment, the transport containment assembly includes a supply duct in fluid communication between the refrigeration unit and a leading box of the plurality of boxes, and wherein the supply duct is detachably connected to the leading box; and a return duct in fluid communication between the refrigeration unit and a trailing box of the plurality of boxes, and wherein the return duct is detachably connected to the trailing box.

In the alternative or additionally thereto, in the foregoing embodiment, at least a portion of the plurality of boxes include a temperature sensor for measuring temperature of the cooling air.

In the alternative or additionally thereto, in the foregoing embodiment, each one of the plurality of boxes include a contoured top surface and a contoured bottom surface for stacking and guiding the plurality of boxes on top of one-another.

In the alternative or additionally thereto, in the foregoing embodiment, one of the top and bottom surfaces includes at least one groove and the other of the top and bottom surfaces includes at least one rail for receipt in the groove.

In the alternative or additionally thereto, in the foregoing embodiment, the grooves and the rails extend longitudinally in the direction of box engagement.

In the alternative or additionally thereto, in the foregoing embodiment, each one of the plurality of boxes include an inlet port and an outlet port for the flow of cooling air.

In the alternative or additionally thereto, in the foregoing embodiment, the transport containment assembly includes a first isolation device constructed and arranged to close the inlet port; and a second isolation device constructed and arranged to close the outlet port.

In the alternative or additionally thereto, in the foregoing embodiment, the first isolation device includes a pivoting damper and a resilient member, wherein the pivoting damper is biased in a closed position by the resilient member.

In the alternative or additionally thereto, in the foregoing embodiment, the flow of cooling air produces a differential pressure across the pivoting damper sufficient to open the first isolation device.

In the alternative or additionally thereto, in the foregoing embodiment, the second isolation device includes a shutter constructed and arranged to slide over the outlet port.

In the alternative or additionally thereto, in the foregoing embodiment, the transport containment assembly includes an alignment feature carried between adjacent first and second boxes of the plurality of boxes for aligning the outlet port of the first box with the inlet port of the second box.

A modular box for a transport containment assembly including a refrigeration unit, according to another, non-limiting, embodiment includes a plurality of walls defining a cavity for transport of cargo, wherein inlet and outlet ports are defined by and communicate through at least one of the plurality of walls for the flow of cooling air; a first isolation device constructed and arranged to close the inlet port and supported by at least one of the plurality of walls; and a second isolation device constructed and arranged to close the outlet port and supported by at least one of the plurality of walls.

The foregoing features and elements may be combined in various combinations without exclusivity, unless expressly indicated otherwise. These features and elements as well as the operation thereof will become more apparent in light of the following description and the accompanying drawings. However, it should be understood that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
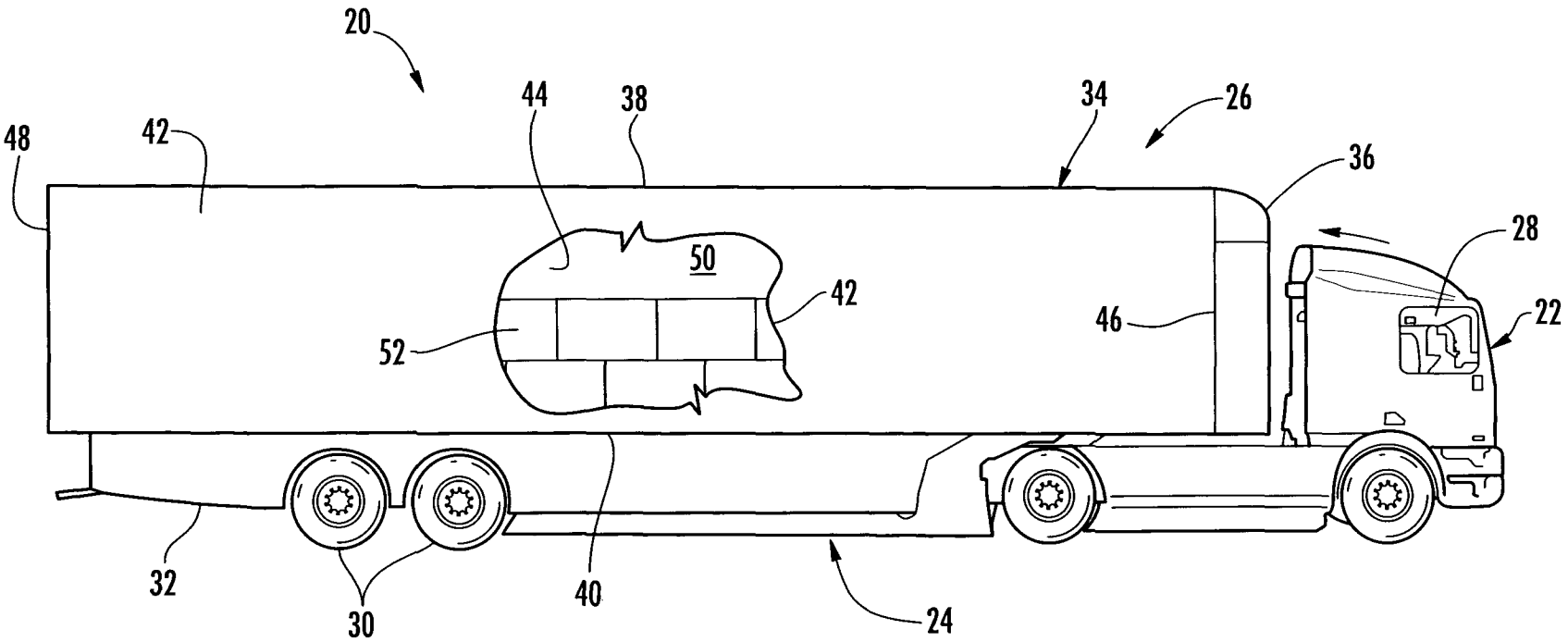
FIG. 1 is a side view of a tractor trailer system as one, non-limiting, application of a transport containment assembly of the present disclosure.

Referring to FIG. 1, one, non-limiting, application for a transport containment assembly of the present disclosure is illustrated as a tractor trailer system 20. The tractor trailer system 20 may include a tractor 22, a trailer 24 and the transport containment assembly 26 that may be refrigerated. The tractor 22 may include an operator's compartment or cab 28 and an engine (not shown) which is part of the powertrain or drive system of the tractor 22. The trailer 24 may include a plurality of wheels 30 rotationally engaged to a frame or platform 32 that may be detachably coupled to the tractor 22. The frame 32 is constructed to support the containment assembly 26 for ground transport to desired destinations. The containment assembly 26 may be an integral part of the frame 32 or may be constructed for removal from the frame.

The transport containment assembly 26 may include a container 34 and a refrigeration unit 36. The container 34 may include top, bottom, two sides, front and rear walls 38, 40, 42, 44, 46, 48 (also see FIG. 2) that together define the boundaries of a cargo compartment 50. The refrigeration unit 36 may be an integral part of the container 34 and located at or near the front wall 46, and is constructed to cool cargo located in the cargo compartment 50. The container 34 may further include doors (not shown) at the rear wall 48, or any other wall. It is contemplated and understood that the transport containment assembly 26 may be constructed for other types of transportation other than tractor trailer systems and/or may be adapted for use in multiple types of transportation (e.g., ground, sea, and/or air). It is further understood that the container 34 may be any shape and may not be completely enclosed (e.g., no top wall 38 and/or no side walls 42, 44, etc.).

Figure 2:
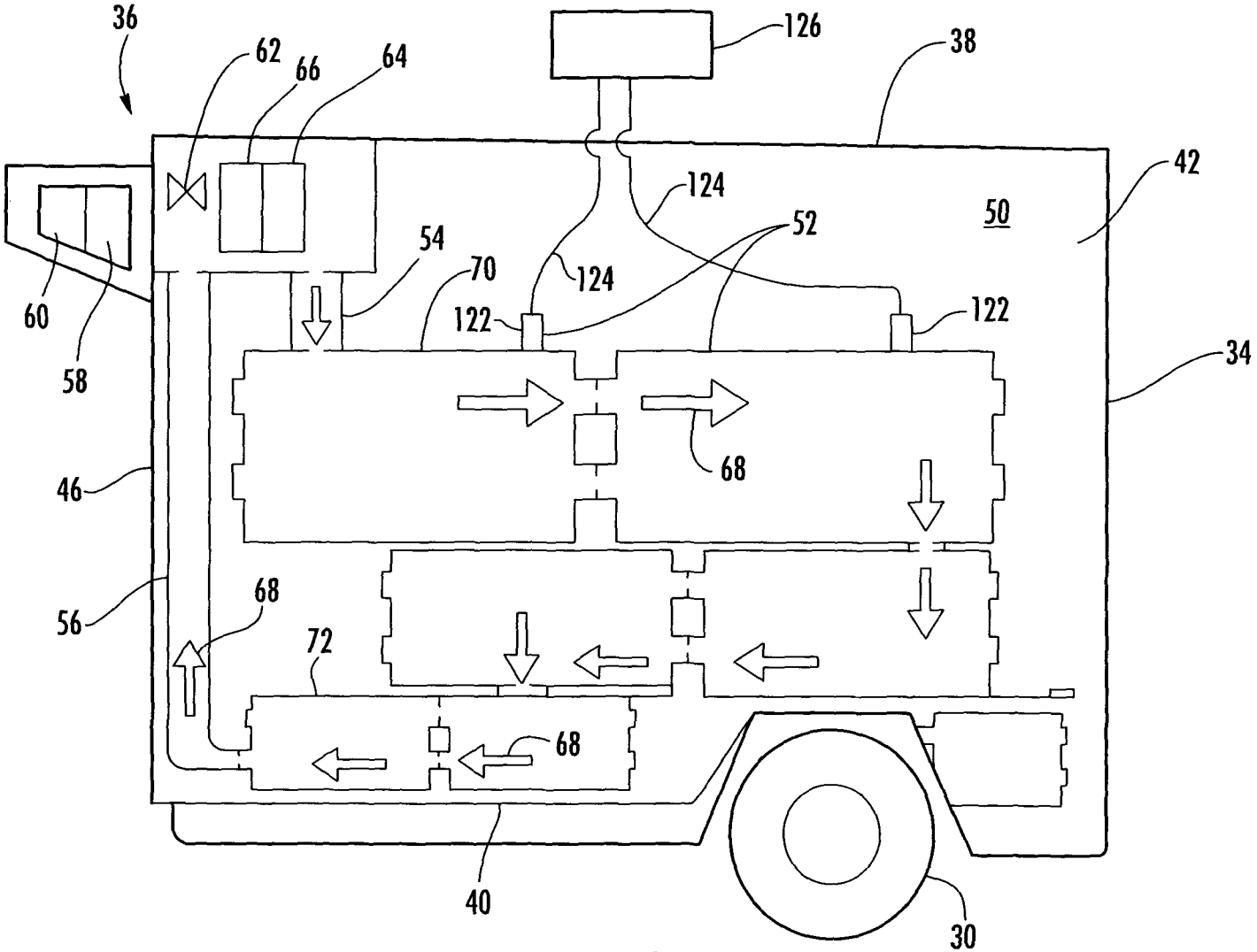
FIG. 2 is a schematic of the transport containment assembly as one, non-limiting, exemplary embodiment of the present disclosure.

Referring to FIG. 2, the transport containment assembly 26 further includes a plurality of boxes 52 that may be modular, a refrigerated air supply duct 54 and an air return duct 56. The refrigeration unit 36 may include a compressor 58, a condenser 60, an expansion valve 62, an evaporator 64, and an evaporator fan or blower 66. The compressor 58 may be powered by an electrical generator driven by an engine system (not shown). The fan 66 drives cooling air (see arrows 68) through the evaporator 64, through the supply duct 54 and into the boxes 52. From the boxes 52, the cooling air returns to the refrigeration unit 36 via the return duct 56.

The boxes 52 may be aligned in series with one-another such that cooling air 68 flows from a leading box 70 and to the next adjacent box. The cooling air 68 flows from one cooling box to the next adjacent cooling box, and until the cooling air flows through a trailing box 72. Upon exiting the trailing box 72, the cooling air 68 flows through the return duct 56 and back to the refrigeration unit 36. The supply duct 54 and the return duct 56 may be flexible and are detachably engaged to the respective leading and trailing boxes 70, 72, and each box 52 is detachably engaged, and in fluid communication with, the next adjacent box for the flow of cooling air 68. The boxes 52 are generally stacked and sorted for easy removal of one box from the remaining boxes once the box has reached its delivery destination. The plurality of boxes 52 may be stacked in a multitude of rows. The shape and size of the boxes 52 may vary along with the height of each row and may be dependent, at least in-part, on the shape and/or various contours of the compartment 50.

Figure 3:
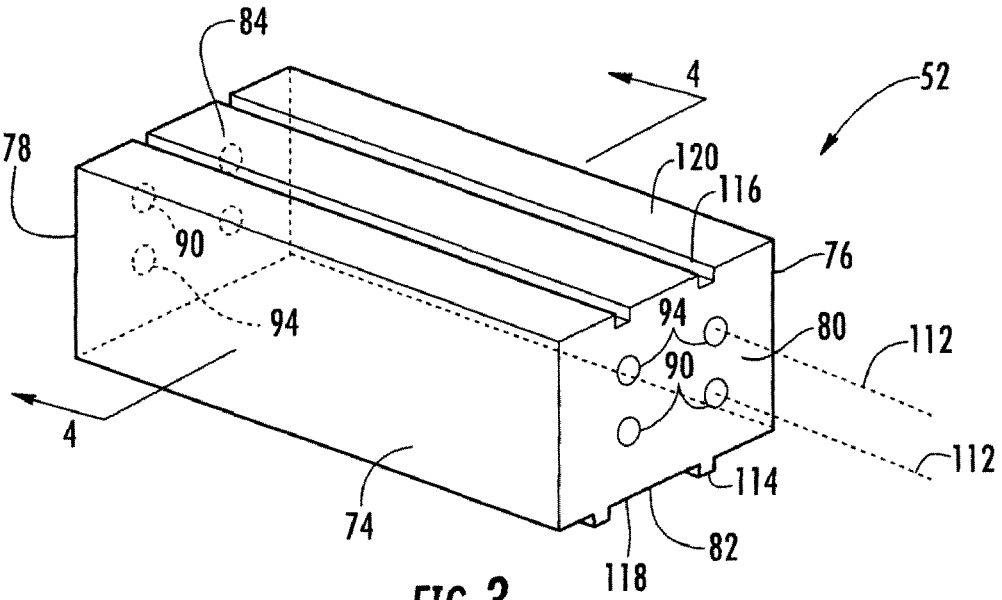
FIG. 3 is a perspective view of a modular box of the transport containment assembly.
Figure 4:
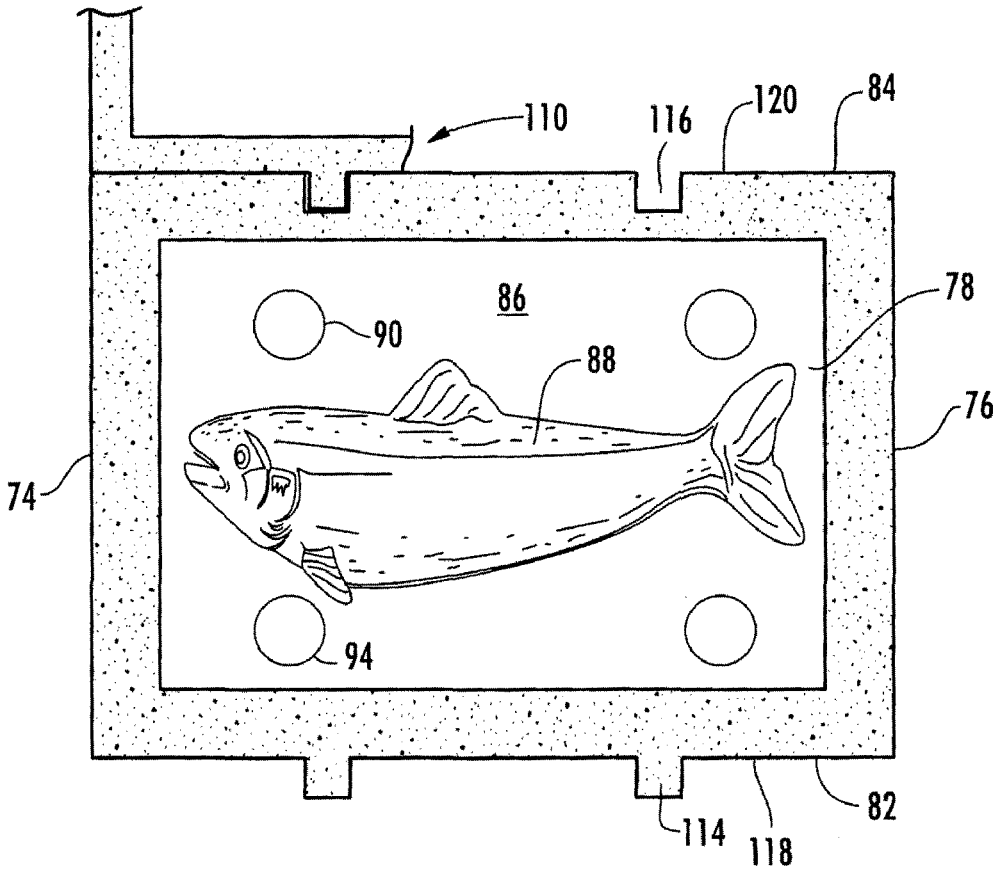
FIG. 4 is a cross section of the modular box viewing in the direction of line 4-4 in FIG. 3.
Figure 5:
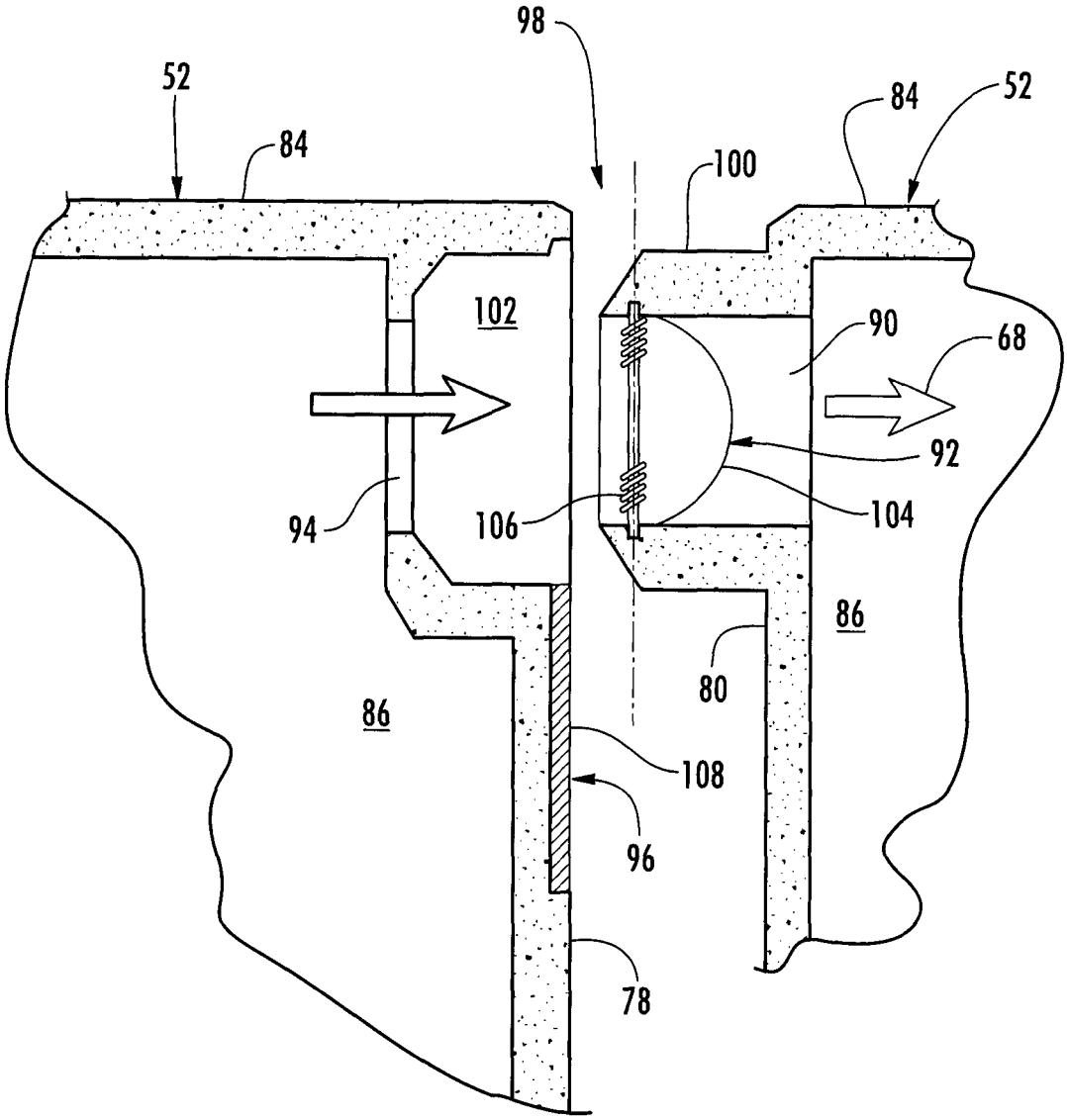
FIG. 5 is a partial cross section of two adjacent modular boxes illustrating inlet and outlet ports with associated isolation devices.

Referring to FIGS. 3 through 5, each box 52 may be thermally insulated and may include opposite side walls 74, 76, opposite end walls 78, 80, a bottom wall 82, and a top wall 84. The walls 74, 76, 78, 80, 82, 84 together define the boundaries of a thermally insulated cavity 86 for the storage and transport of cargo 88 that may require refrigeration. The end walls 78, 80 may each include at least one inlet port 90 with an associated first isolation device 92 and at least one outlet port 94 with an associated second isolation device 96. The first and second isolation devices 92, 96 are configured to close when the associated boxes 52 are removed from the transport container 34 (or are otherwise not associated with an adjacent box). With the box 52 removed from the container 34 and no longer in fluid communication with the remaining boxes, closure of the isolation devices 92, 96 in the thermally insulated box 52 preserves the cold environment of the cavity 86.

Referring to FIG. 5, an alignment feature 98 is generally carried between adjacent boxes 52 and may be associated with, or proximate to, the respective inlet and outlet ports 90, 94. In one example, the alignment feature 98 may include a collar 100 that projects outward from a leading end wall 80 of a trailing box 52, and a counter bore 102 in a trailing end wall 78 of the adjacent leading box. The collar 100 may define the boundaries of the inlet port 90 in the leading end wall 80, and the counter bore 102 (in the trailing end wall 78 of the adjacent leading box) may be concentric to and in fluid communication with the outlet port 94 in the same trailing end wall 78. When the leading box 52 is adjacent to the trailing box, the collar 100, projecting outward from the leading end wall 80 of the trailing box, may fit snugly into the counter bore 102 in the trailing end wall 78 of the leading box.

As one, non-limiting, example, the isolation device 92 may include a damper 104 pivotally connected to the collar 100 and configured to be pivotally biased in a closed position (i.e. closes-off the inlet port 90). The damper 104 may be biased toward the closed position by a resilient member 106 that may be a spring. A force created by a differential pressure across the inlet port 90 (i.e., induced by the cooling air 68 flow) may be sufficient to overcome the biasing force of the resilient member 106 and thereby open the isolation device 92. As one, non-limiting, example, the isolation device 90 for the outlet port 94 may include a shutter 108 that is manually slid over the outlet port 94 when the associated box 52 is removed from the container 34.

It is further contemplated and understood that each end wall 78, 80 of each box 52 may include both inlet and outlet ports 90, 94 for versatility of positioning the boxes 52 within the container 34. Moreover, the bottom and top walls 82, 84 may have similar inlet and outlet ports for the flow of cooling air 68 between rows of boxes 52 (see FIG. 2) and detachable engagement of the supply and/or return ducts 54, 56. It is further contemplated and understood that the isolation devices 92, 96 may be mechanically actuated by the act of coupling one box 52 to the next adjacent box (i.e., act of indexing one box 52 to the next adjacent box). In this example, the isolation devices 92, 96 may be identical and the inlet and outlet ports 90, 94 may be the same (i.e., direction of airflow through ports 90, 94 is dependent upon the positioning of the box 52).

Referring to FIGS. 3 and 4, the boxes 52 may be stacked directly adjacent to one another with the top wall 84 of a lower box in contact with a bottom wall 82 of an upper box. An indexing feature 110 may be carried between the upper and lower boxes 52 that aligns the boxes axially with respect to centerlines 112 of the coupling inlet and outlet ports 90, 94. The indexing feature 110 may further guide the coupling of leading and trailing boxes. The indexing feature 110 may include at least one rail 114 (i.e. two illustrated) and at least one groove 116 for sliding receipt of the rail 114. The rail 114 (i.e., two illustrated) may be defined by the contours of an external, bottom, surface 118 carried by the top bottom wall 82. The groove 116 may have boundaries defined by the contours of an external, top, surface 120 carried by the top wall 84. It is further contemplated and understood the location of the rails 114 and grooves 116 may be interchanged.

Referring to FIG. 2, each modular box 52 may include a temperature sensor 122 that outputs a temperature signal 124 to an electronic, central, device 126 that may monitor and record temperatures within each box and/or may utilize the temperature signal 124 to, at least in-part, control the refrigeration unit 36. It is further contemplated and understood that not all boxes may require temperature sensors 122. Moreover and for the purpose of controlling the refrigeration unit 36, the temperature sensor(s) may be located in the supply and/or return ducts 54, 56 (not shown).

While the present disclosure is described with reference to exemplary embodiments, it will be understood by those skilled in the art that various changes may be made and equivalents may be substituted without departing from the spirit and scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. A transport refrigeration unit comprising:

a refrigeration unit;

a container;

a plurality of boxes for storage of cargo and configured in series with one-another for a flow of cooling air from the refrigeration unit, wherein each one of the plurality of boxes include an inlet port and an outlet port for the flow of cooling air;

a first isolation device constructed and arranged to close the inlet port; and a second isolation device constructed and arranged to close the outlet port.

2. The transport refrigeration unit set forth in claim 1, wherein the first isolation device includes a pivoting damper and a resilient member, wherein the pivoting damper is biased in a closed position by the resilient member.

3. The transport refrigeration unit set forth in claim 2, wherein the flow of cooling air produces a differential pressure across the pivoting damper sufficient to open the first isolation device.

4. The transport refrigeration unit set forth in claim 1, wherein the second isolation device includes a shutter constructed and arranged to slide over the outlet port.

* * * * *